US005186992A

United States Patent [19]

Kite, III

[11] Patent Number: 5,186,992

[45] Date of Patent: Feb. 16, 1993

[54] BRAIDED PRODUCT AND METHOD OF MAKING SAME

[75] Inventor: J. Sellers Kite, III, West Chester, Pa.

[73] Assignee: The Bentley-Harris Manufacturing Company, Lionville, Pa.

[21] Appl. No.: 890,297

[22] Filed: May 27, 1992

Related U.S. Application Data

[63] Continuation of Ser. No. 492,802, Mar. 12, 1990, abandoned.

[51] Int. Cl.[5] ..... B32B 1/08

[52] U.S. Cl. ..... 428/36.3; 87/8; 87/9; 428/36.1; 428/198; 428/225; 428/245; 428/255

[58] Field of Search ..... 428/225, 245, 255, 198, 428/36.1, 36.3; 87/6, 8, 9

[56] References Cited

U.S. PATENT DOCUMENTS

| | | | |
|---|---|---|---|
| 2,025,052 | 12/1935 | Hess . | |
| 2,393,530 | 1/1946 | Harris . | |
| 2,478,940 | 8/1949 | Pape . | |
| 2,580,436 | 1/1952 | Knoblaugh . | |
| 2,686,451 | 8/1954 | Shafer . | |
| 2,977,839 | 4/1961 | Koch . | |
| 3,048,078 | 8/1962 | Kaplan . | |
| 3,130,630 | 4/1964 | Dawes . | |
| 3,334,165 | 8/1967 | Koch | 87/9 |
| 3,726,321 | 4/1973 | Phillips et al. | 138/123 |
| 3,855,897 | 12/1974 | Takahashi et al. | 87/1 |
| 3,911,785 | 10/1975 | Hood | 87/1 |
| 4,019,940 | 4/1977 | Hood | 87/1 |
| 4,376,229 | 3/1983 | Maul et al. | 138/121 |
| 4,389,763 | 6/1983 | Mush, Jr. | 29/237 |
| 4,452,279 | 6/1984 | Atwell | 138/126 |
| 4,604,821 | 8/1986 | Moser | 87/8 |
| 4,735,833 | 4/1988 | Chistis et al. | 428/229 |
| 4,754,685 | 7/1988 | Kite et al. | 138/123 |
| 4,819,395 | 4/1989 | Sugita et al. | 52/309.16 |
| 4,862,922 | 9/1989 | Kite, III | 428/36.3 |
| 4,870,887 | 10/1989 | Tressler et al. | 87/9 |
| 4,891,256 | 1/1990 | Kite, III et al. | 428/36.3 |
| 4,929,478 | 5/1990 | Conaghan et al. | 428/36.3 |
| 4,939,819 | 7/1990 | Moyer | 24/16 R |
| 4,946,722 | 8/1990 | Moyer | 87/9 |
| 5,000,228 | 3/1991 | Manent et al. | 138/124 |

FOREIGN PATENT DOCUMENTS

| | | |
|---|---|---|
| 697847 | 9/1953 | United Kingdom . |
| 1422936 | 1/1976 | United Kingdom . |
| 1448601 | 9/1976 | United Kingdom . |

*Primary Examiner*—James J. Bell
*Attorney, Agent, or Firm*—Synnestvedt & Lechner

[57] ABSTRACT

An expandable braided product having greatly reduced tendency to splay at its ends when cut is provided by coating the braided product with a thin layer of elastomeric material which provides the desired anti-splaying property, while retaining the expandable characteristic whereby the product expands laterally when compressed longitudinally and when released returns to its original size and shape.

6 Claims, 2 Drawing Sheets

BRAIDED PRODUCT AND METHOD OF MAKING SAME

This is a continuation of copending application Ser. No. 07/492,802 filed on Mar. 12, 1990, now abandoned.

FIELD OF THE INVENTION

This invention relates to monofilament braided product and to methods for making same. It relates particularly to braided product made up of monofilaments, typically of a resilient engineered plastic material and typically (but not necessarily) in the form of a tubular sleeve.

BACKGROUND OF THE INVENTION

One known form of braided product is the Expando TM self-fitting protective oversleeve made by Bentley-Harris Manufacturing Co. of Lionville, Pa. This tubular sleeve is expandable in that, when the ends are pushed toward each other it expands in diameter, and when they are released it returns to its original shape and size. This enables it to be pulled or pushed over objects of different diameters, including diameters greater than the unstressed or "rest" diameter of the sleeve, and also enables it to accommodate expansion, bending and twisting of hoses or wires which may run through it. This expandable braided product also exhibits a "spring-back" or "memory" characteristic, whereby it tends to return to its rest diameter when released from longitudinal forces. Such expandable braided sleeving has been widely used, for example to protect, and/or dress, wiring harnesses and hose assemblies.

One difficulty with the typical braided product of the expandable type is that when the braid is cut in an ordinary manner, as by scissors, the ends of the braid will tend to unravel or splay, the braiding coming apart for a substantial distance back from the cut ends. This is particularly troublesome when an end of a braided sleeve must be forced over a large-diameter object, causing the monofilaments to splay and therefore no longer provide the desired type of tight fit on the samller-diameter contents of the tubular covering; in addition, such splaying is cosmetically very undesirable.

There are currently three principal ways in which this problem has been addressed, as follows:

(1) Coat the braided product with a continuous coating. This eliminates the splaying, but also restricts the expandability of the braid and therefore its ability to slide over, or wrap around, an object with full conformity to a variable cross-section of the object. Such a construction also prevents one from "breaking out" a branching wire from the interior of braided tubing, as is sometimes desirable.

(2) Heat-set the braided product. Heating the completed product will put a slight set into the braid, but with even slight mechanical expansion the ends will unbraid and splay out again.

(3) Cut the braid with a hot knife or wire. With most plastic braidings, the sleeve can be cut through with a hot knife or wire, thereby fusing the monofilaments to each other to prevent the braid from fraying or unraveling. However, such end treatment will fix the diameter at that set by the fusing of the end of the tubular braid, and thereby prevent the braid from expanding readily to receive a large object. Further, this method requires use of special hot melt devices to provide such cutting of the braid, and therefore is not useful for field installations of the sleeve where no such special tools are available.

Accordingly, it is an object of the present invention to provide a new braided product and method of making it, which minimize such fraying while retaining the natural expansion and contraction characteristics of the expandable type of braided product.

It is also an object of the invention to provide such method and apparatus in which the treatment providing the above described advantageous characteristics is readily and inexpensively performed, and in which the user can cut the resultant braided product to the desired length without having to use any special cutting or bonding tools.

SUMMARY OF THE INVENTION

These and other objects of the invention are achieved by the provision of a monofilament braided product in which the braided product is at least partly coated with an adherent, preferably elastomeric, material extending from at least some over-weave monofilaments to their associated underweave monofilaments at their respective cross-overs, permitting the monofilaments to pivot with respect to each other as required to retain the desired expandable characteristics, while preventing splaying. The coating is preferably of an elastomeric material, and preferably does not completely cover the openings between the monofilaments.

The coating is preferably applied by passing the braid continuously through a liquid bath containing the coating material in flowable form, and then solidifying the coating in position on the braided product. The viscosity of the liquid of the coating is such that it provides enough material in the proper places to fix the monofilaments against end splaying, while retaining the ability of the filaments to pivot with respect to each other, and the consequent ability of the sleeve to expand and shrink in cross-sectional size. If the coating does initially extend across the openings between the monofilaments, it is preferably such as to break upon longitudinal compression of the braided material, although with a sufficiently compliant elastomeric material this is not always necessary.

In this manner there is provided a braided product and method of making it which prevent splaying of the end of the braid without materially adversely affecting the expandable characteristics of the braid.

BRIEF DESCRIPTION OF FIGURES

These and other objects of the invention will be understood from a consideration of the following detailed description taken in connection with the accompanying drawings, in which.

DETAILED DESCRIPTION OF SPECIFIC EMBODIMENTS

Figure 1:
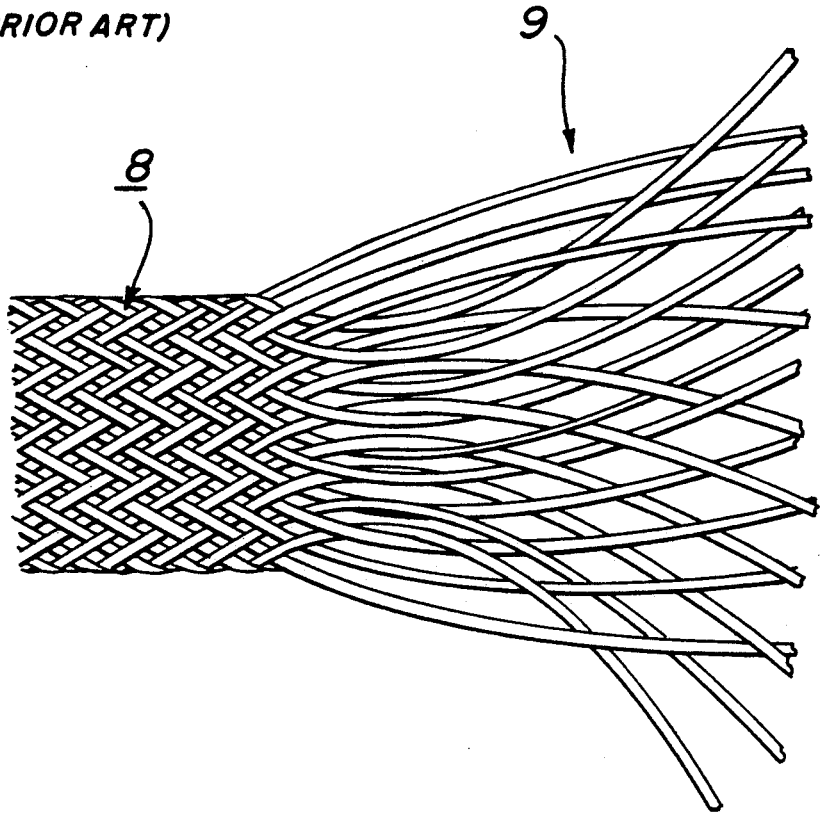
FIG. 1 (PRIOR ART)
FIG. 1 is a side view of a section of expandable tubular product which has been cut by an ordinary pair of scissors, and mechanically expanded at the cut end, and which exhibits substantial splaying at its end.
Figure 2:
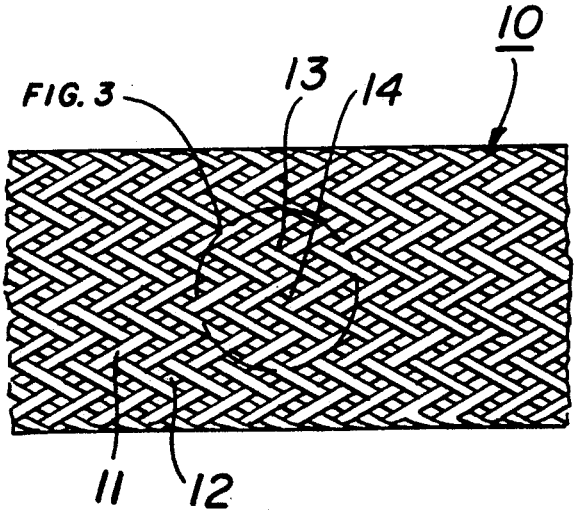
FIG. 2 is a side view of a section of expandable braided product made in accordance with the invention, cut at its end with an ordinary pair of scissors and then subjected to a similar expanding procedure.
Figure 3:
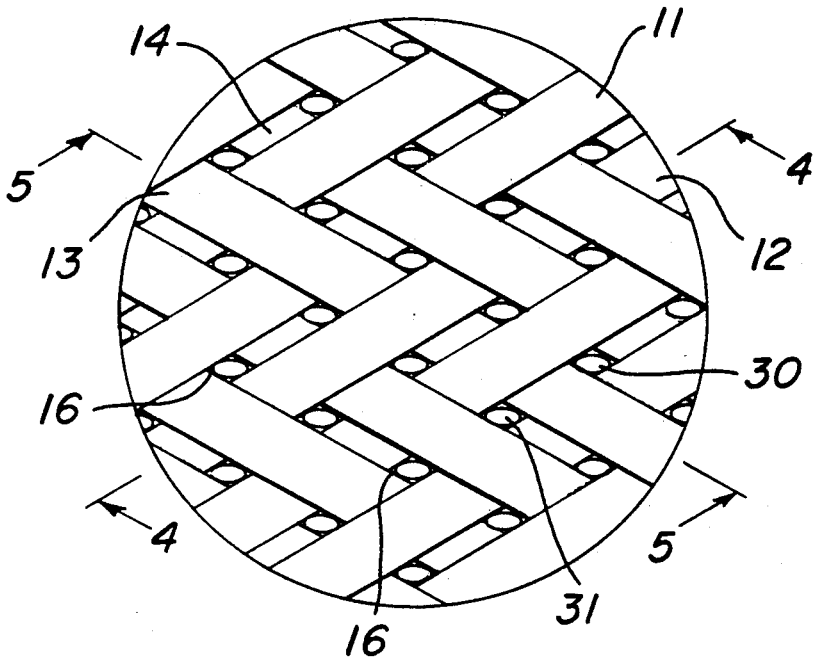
FIG. 3 is an enlarged fragmentary view of the exterior of the braided product of FIG. 2.
Figure 4:
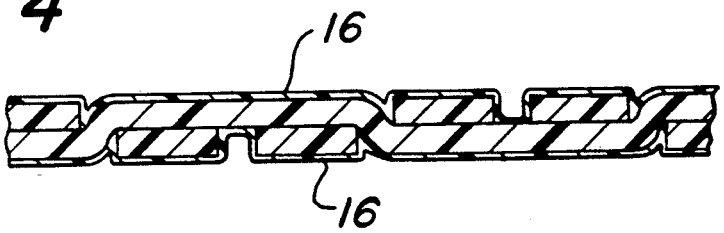
FIG. 4 is a cross-sectional view taken on lines 4—4 of FIG. 3, showing the braided product of the invention after the coating has been formed therein.
Figure 5:
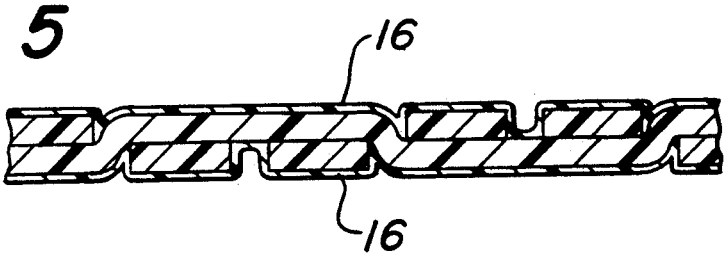
FIG. 5 is a cross-sectional view taken along lines 5—5 of FIG. 3.
Figure 6:
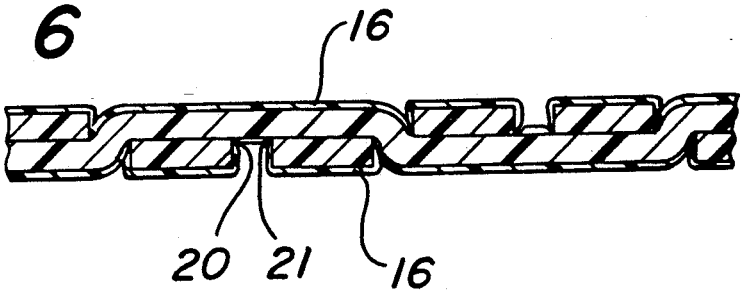
FIG. 6 is a cross-sectional view like FIG. 5, but illustrating the condition in which a break exists in the coating near each cross-over of the braid.

Referring now to the embodiment of the invention shown in the drawings by way of example only, and without thereby limiting the scope of the invention, FIG. 1 shows a section of expanded, braided tubular sleeving 8, constructed in accordance with the prior art and exhibiting undesired splaying of the monofilaments at its end 9. FIG. 2 shows a length of expandable, braided, tubular sleeving 10 in accordance with the present embodiment of the invention. It is made up of monofilaments such as 11, 12, 13 and 14 in a simple single-strand two-over, two-under braid pattern. Each monofilament in this example is of engineered plastic, for example nylon or polyester, and is substantially rectangular in cross-section. The monofilaments are covered with an adherent elastomeric coating 16. In some cases, particularly after expansion and contraction of the braid by pulling and pushing of its ends, the coating may contain a break where one monofilament crosses another, as indicated by the break lines such as 20, 21 in FIG. 6.

In this preferred embodiment of the invention the coating does not decrease substantially the areas of the openings such as 30, 31 between the monofilaments, so that space remains for the filaments to pivot at the cross-overs, one with respect to its adjacent neighbor, during expansion and contraction of the sleeve, according to the usual characteristic of such expandable braids. The elastomeric coating tends to fix the positions of the cross-overs, but being elastomeric, it permits the necessary pivoting of the monofilaments with respect to each other. This fixing action of the elastomeric material prevents the ends from splaying, as is important for the reasons pointed out above. The retention of the openings such as 30, 31 also permits a wire or the like to be extracted and passed outwardly from the sleeve if so desired.

While there may be a variety of methods by which the coating may be applied, it is preferred to accomplish it by passing a continuous sleeve of the braided material through a bath of the coating material and then drying it in an oven.

One presently-preferred example of the improved braided product and of a method for making it, is as follows:

A continuous, expandable braided tube of about ⅝ inch rest diameter is made in conventional manner from 48 monofilaments of 2000 denier nylon, each monofilament about 30 mils wide and about 10 mils in thickness; the braided tubing is typically coiled on a spool in long lengths, e.g. in 2,000 foot lengths. The tubing from the spool is then run lengthwise downward into and through a bath of the coating material, continuing upwardly therefrom through a hot-air oven typically operating at about 300° F.

The liquid coating material may be resorcinol formaldehyde, with a viscosity of 15,000 centipoises or less so that it will coat the monofilaments in the braid without closing the openings between them. Preferably the tubing is subjected to stretching while passing through the bath, and until drying of the coating is complete. Typical thicknesses for the coating are from 1 to 20 mils.

The resultant braided tubing can be cut to length with ordinary scissors, and will then exhibit minimal tendency toward splaying. Nevertheless, when longitudinally compressed it will increase its diameter and when stretched it will regain its original diameter, and it will also exhibit memory in that, when unstressed, it tends to return to the diameter and length it had before compression.

In general, the invention is applicable to a wide variety of sizes, shapes and materials of braids and of monofilaments, including monofilaments of round cross-section; it is also of wide applicability with respect to the number of monofilaments in the braid. While many important applications of the invention involve a tubular braid, the invention is also useful in making flat, mat-like expandable braid products. Also, while the coating materials is preferably elastomeric, at least some of the advantages of the invention may be realized by using a non-elastomeric material for the coating which does not bond the filaments rigidly together, but instead fractures upon compression and/or stretching of the braid, leaving low walls of coating material on each side of each monofilament at each cross-over to provide a positioning channel, or at least a high-friction surface, which resists the type of displacement of the monofilaments which occurs during splaying. A similar effect exists in some cases when an elastomeric material is used which fractures during stretching and/or compression. Other coating procedures may also be used, so long as they do not result in such a thick, pervasive coating that the monofilaments cannot pivot, each with respect to its neighbor, as is required to exhibit the desired expandable characteristic.

While the invention has been described with particular reference to specific embodiments thereof in the interest of complete definiteness, it may be embodied in a variety of forms diverse from those specifically shown and described, without departing from the spirit and scope of the invention.

What is claimed is:

1. A braided product which, when compressed along a first direction, expands along a second direction transverse to said first direction and when released tends to return to its original configuration, comprising:

a plurality of over-and-under mutually-crossing braided monofilaments forming with each other a plurality of monofilament cross-overs, with apertures extending through said braided product between said monofilaments; and a thin deposit of an elastomeric material extending over the exterior surfaces of said monofilaments at each of said cross-overs but leaving said apertures at least partially open, said elastomeric material differing from the material of said monofilaments and serving as a resilient adhesive for holding said monofilaments against mutual lateral motion while permitting them to pivot with respect to each other at said cross-overs.

2. The braided product of claim 1, wherein said elastomeric material is selected from the group consisting of resorcinol formaldehyde and acrylic latex.

3. The braided product of claim 1, wherein said product is a braided sleeve.

4. The braided product of claim 1, wherein said monofilaments are of engineered plastic.

5. The braided product of claim 1, wherein said monofilaments are selected from the group consisting of nylon and polyester.

6. The braided product of claim 1, wherein said product is a sleeve, said monofilaments are of a material selected from the group consisting of nylon and polyester, and said elastomeric material is selected from the group consisting of resorcinol formaldehyde and acrylic latex.

* * * * *

UNITED STATES PATENT AND TRADEMARK OFFICE

CERTIFICATE OF CORRECTION

PATENT NO. : 5,186,992

DATED : February 16, 1993

INVENTOR(S) : J. Sellers Kite, III

It is certified that error appears in the above-identified patent and that said Letters Patent is hereby corrected as shown below:

Column 3, line 54, change "5/8" to --3/8--.

Signed and Sealed this

Thirtieth Day of November, 1993

*Attest:*

*Attesting Officer*

BRUCE LEHMAN

*Commissioner of Patents and Trademarks*